US005224860A

United States Patent [19]

Waldman et al.

[11] Patent Number: 5,224,860

[45] Date of Patent: Jul. 6, 1993

[54] HARDWARE-IN-THE-LOOP TOW MISSILE SYSTEM SIMULATOR

[75] Inventors: Gary S. Waldman; John R. Wootton, both of Creve Coeur; Gregory L. Hobson, St. Peters; David L. Holder, St. Charles, all of Mo.

[73] Assignee: Electronics & Space Corp., St. Louis, Mo.

[21] Appl. No.: 662,936

[22] Filed: Mar. 1, 1991

[51] Int. Cl.[5] ..... F41G 3/26

[52] U.S. Cl. ..... 434/21; 434/12; 434/22; 273/312; 273/348.1; 358/104; 250/330; 340/702; 353/11; 359/641

[58] Field of Search ..... 434/11, 12, 16, 17, 434/19, 20, 21, 23, 27, 22; 273/312, 333, 348.1; 358/125, 103-105; 340/702; 250/223 B, 224, 330; 353/98, 66, 11, 12; 356/241, 445; 359/641

[56] References Cited

U.S. PATENT DOCUMENTS

| | | | |
|---|---|---|---|
| 3,352,965 | 11/1967 | Driver et al. | 358/93 X |
| 4,232,456 | 11/1980 | Harmon et al. | 434/12 |
| 4,290,757 | 9/1981 | Marshall et al. | 434/12 |
| 4,439,156 | 3/1984 | Marshall et al. | 434/12 |
| 4,534,735 | 8/1985 | Allard et al. | 434/20 |
| 4,552,533 | 11/1985 | Walmsley | 434/12 |
| 4,585,418 | 4/1986 | Stickel | 434/20 |

FOREIGN PATENT DOCUMENTS 1372783 11/1974 United Kingdom ..... 434/11

*Primary Examiner*—Richard J. Apley
*Assistant Examiner*—Joe Cheng
*Attorney, Agent, or Firm*—Polster, Lieder, Woodruff & Lucchesi

[57] ABSTRACT

A "hardware-in-the-loop" simulator (10) for training people in the use of a missile system to teach target acquisition, missile launch, and missile guidance under simulated battlefield conditions. A battlefield environment (E) including at least one target (T) movable therewithin is created by a simulation module (12). Missile system hardware (H) including the missile acquisition, tracking, and guidance portions is provided. An interface module (20) converts signals produced by the simulating module to an infrared image acceptable by the hardware. The resultant image represents a field-of-view (FOV), including the target, within the battlefield environment. An image module (32) produces a dynamic image representative of the missile's position in the field-of-view. This image is observable by the hardware which utilizes it to determine the position of the missile relative to the target. The hardware also determines if a missile guidance signal is to be sent to the missile to guide it to the target. If so, the interface module is responsive to the guidance signal to simulate, in real-time, the response of the missile to the guidance signal.

21 Claims, 3 Drawing Sheets

HARDWARE-IN-THE-LOOP TOW MISSILE SYSTEM SIMULATOR

BACKGROUND OF THE INVENTION

This invention relates to simulators and, more particularly, to a missile system simulator for a TOW missile system in which the infrared source on a TOW missile is effectively simulated as well as target dynamics, launch platform dynamics, battlefield backgrounds, and atmospheric conditions.

As is well-known, TOW missile systems have been developed for both ground based and airborne applications. As these systems have proliferated, the need for training personnel in their usage has become increasingly important. Because of the amount of time required to train large numbers of people, and the attendant cost, it has become increasingly important to provide a training program which does not actually require the firing of a TOW missile. Further, adequate training involves training one to aim, fire, and guide the missile to a target under different sets of conditions, e.g. day, night, clear, obscure, the presence of countermeasures, etc. As a practical matter, it is not always possible to produce these various conditions in the field; or, if it were, the time and cost required for a training program could be prohibitive.

In response to the foregoing, numerous attempts have been made to develop TOW system simulators. A prime requirement for these simulators is that they be "hardware-in-the-loop" simulators that simulate various targets against different backgrounds with various atmospheric conditions and utilize actual system hardware in the simulation. The simulators also need to simulate the missile signature both during the initial launch phase and as it moves downrange. In this regard, it will be understood that in the initial launch phase, the signature corresponds to a plume of exhaust (a "butterfly" pattern) created by the firing of the missile's engine and emanating from the sides of the missile. After the missile's fuel is spent, the signature is provided by an infrared beacon whose radiation is received by a forward-looking-infrared-receiver (FLIR) located with the missile launch and guidance equipment. Lastly, the simulation needs to be a "real-time" simulation which enables the trainee to learn to react to what happens as he acquires a target, shoots a missile at it, and guides the missile to the target.

Some existing simulators employ digital simulations in which targets are superimposed upon simulated backgrounds. A radiance map is then generated and projected through an atmospheric model to create a second, or received radiance map. These simulators typically also incorporate a model of the FLIR itself, thereby producing a direct video output which the trainee views. Unfortunately, modeling of the FLIR compromises the effectiveness of the simulator. Approaches have been investigated as to how the FLIR can be properly simulated to provide comprehensive "hardware-in-the-loop" simulation. Among these are martricees of laser diodes, large arrays of variable resistors, a fixed map positioned in front of a heat source with the map having different hole patterns (number and sizes) to, in effect, create a radiance map.

Problems are associated with each of these alternative approaches. For example, diode arrays are complex to drive, and, because approximately one million (1,000,000) diodes may be needed to replicate a scene, expensive. A similar problem exists with the use of resistors. In addition, resistors create a thermal lag problem which is significant when trying to simulate the dynamics of missile movement in real-time. The dynamic range of both diodes and resistors also makes it difficult to simulate targets and missiles on the same array board.

Besides the above, other approaches to simulation could consist of using high-powered lasers which create simulated "hot spots" on a background which is positioned on a table or other support and mechanically moved about. The "hot spot" thus would be viewed as a blob of light corresponding to the infrared signal from the missile beacon, as received by the FLIR. Usually, however, these arrangements are big and cumbersome, prone to breakdowns, not very authentic from a training standpoint, and difficult to modify.

SUMMARY OF THE INVENTION

Among the several objects of the present invention may be noted the provision of a simulator for use in training personnel in the use of a TOW missile system; the provision of such a simulator for training the personnel how to acquire a target in a battlefield situation, fire a TOW missile at the target, and guide the missile to strike the target; the provision of such a simulator which is a "hardware-in-the-loop" simulator that teaches the trainee how to use actual system equipment in the same way he would use it in a battlefield situation; the provision of such a simulator in which the target and background are readily changeable to present the trainee with a wide variety of battlefield situations; the provision of such a simulation to produce an actual infrared signature of a simulated missile so the system equipment will provide the trainee the same type input he will receive in actual usage of the system; the provision of such a simulator to accommodate multiple missiles and targets; the provision of such a simulator to simulate countermeasures employed by a target to avoid being hit by a missile; and, the provision of such a simulator which is easy to understand and to operate and which provides a low-cost alternative to training personnel by having them actually fire large numbers of TOW missiles at targets.

In accordance with the invention, generally stated, a "hardware-in-the-loop" simulator is for training people in the use of a missile system to teach target acquisition, missile launch, and missile guidance under simulated battlefield conditions. A battlefield environment including at least one target movable therewithin is created by a simulation module. Missile system hardware including its missile acquisition, tracking, and guidance portions is provided. An interface module converts signals produced by the simulating module to signals acceptable by the hardware. These signals represent a field-of-view, including the target, within the battlefield environment. An image module produces a dynamic representation of the missile's position in the field-of-view. This position image is acquirable by the hardware which utilizes it to determine the position of the missile relative to the target. The hardware also determines if a missile guidance signal is to be sent to the missile to guide it to the target. If so, the interface module is responsive to the guidance signal to simulate, in real-time, the dynamic response of the missile to the guidance signal. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 1A:
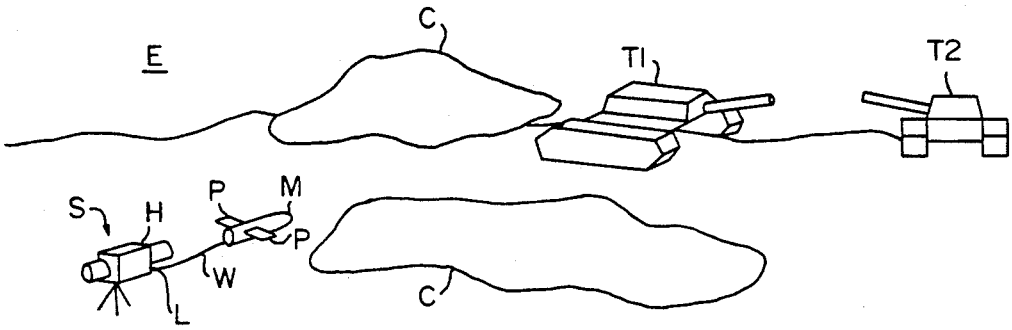
FIGS. 1*a* and 1*b* represent a battlefield scene in which a TOW missile is launched at a target, FIG. 1*a* representing an early stage of missile flight, and FIG. 1*b* a later stage of the flight.
Figure 1B:
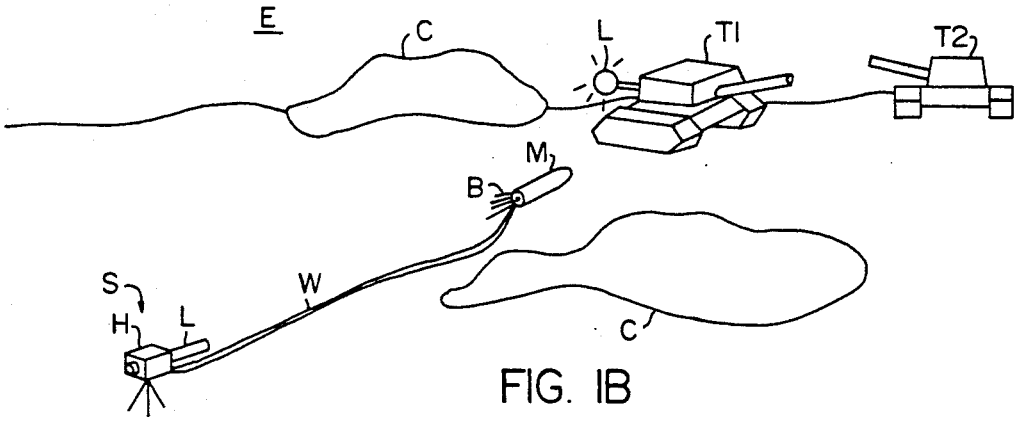

Referring to the FIGS. 1*a* and 1*b*, a TOW missile system S is for use in a battlefield environment E. The system can be either a ground based system as shown in the Figs., or an airborne system such as one installed on a helicopter (not shown). In either instance, the user of the system selects a target such as the tank T1 and fires a TOW missile M at it. The gunner (not shown) uses a launcher L to fire the missile. The system further includes a tracking, guidance and control hardware unit H. Wires W trail behind the missile as it proceeds towards its target, and guidance signals for directing the missile to impact with the target are transmitted over these wires from the hardware to the missile. As shown in FIG. 1*a*, when the missile is first launched, an engine on the missile fires for a period of time and plumes P of exhaust project out each side of the missile. When fuel for the engine is exhausted, the plumes disappear. As the missile moves downrange to the target, a beacon B on the rear of the missile is activated to provide a visual indication of the missile's location. Beacon B is, for example, a xenon beacon and it emits light in the infrared portion of the light spectrum. As further shown in FIGS. 1*a* and 1*b*, other targets such as the tank T2 may be present on the battlefield which may be obscured by clouds C of smoke. The presence of obscurants such as the clouds is one reason an infrared beacon B is used on the missile, since the clouds will not block the infrared radiation from the beacon. Lastly, it is also possible that the target may employ countermeasures such as a light source L in order to cause the missile to be directed away from the target. The countermeasure emits infrared radiation at a wavelength close to that of the beacon in an attempt to confuse the gunner, and the missile system hardware, of the missile's location. This is done with the expectation the missile will then be mistakenly guided away from the target.

Figure 2A:
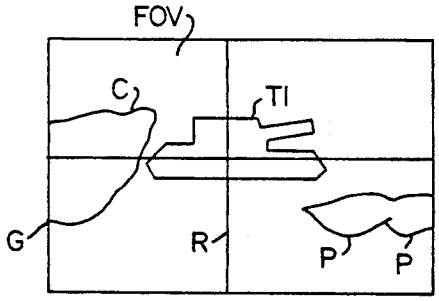
FIGS. 2*a* and 2*b* represent the scene as viewed by a gunner at the times respectively corresponding to FIGS. 1*a* and 1*b;*
Figure 2B:
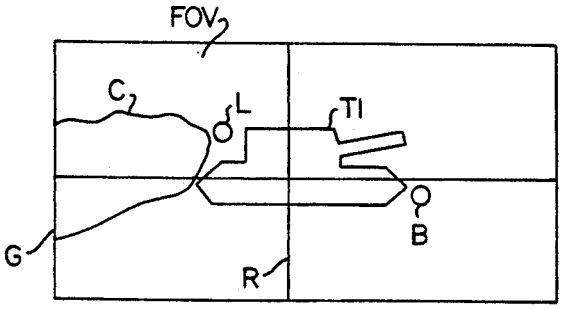

Referring to FIGS. 2*a* and 2*b*, the hardware H includes a sighting unit by which the user can locate the target T1 in a field-of-view FOV. The sighting unit includes a gunsight G having a reticle R the cross-hairs of which the gunner trains on the target As shown in FIG. 2*a*, the missile converges on the target from one side of the gunsight (the right side as shown in the Figs.). Further while the engine is still firing, one, and then both exhaust plumes P will be visible in the sight. The plumes form a "butterfly" pattern by which the gunner can locate the missile. After the engine shutsdown and beacon B is activated, the gunner tracks the missile by the beacon. The sighting unit includes a forward-looking-infrared-receiver or FLIR which is responsive to the infrared radiation from the beacon (as well as infrared radiation from countermeasure light source L). The hardware further includes appropriate circuitry for periodically scanning the field-of-view and converting the sensed infrared radiation to a display viewed by the gunner in his gunsight.

Figure 3:
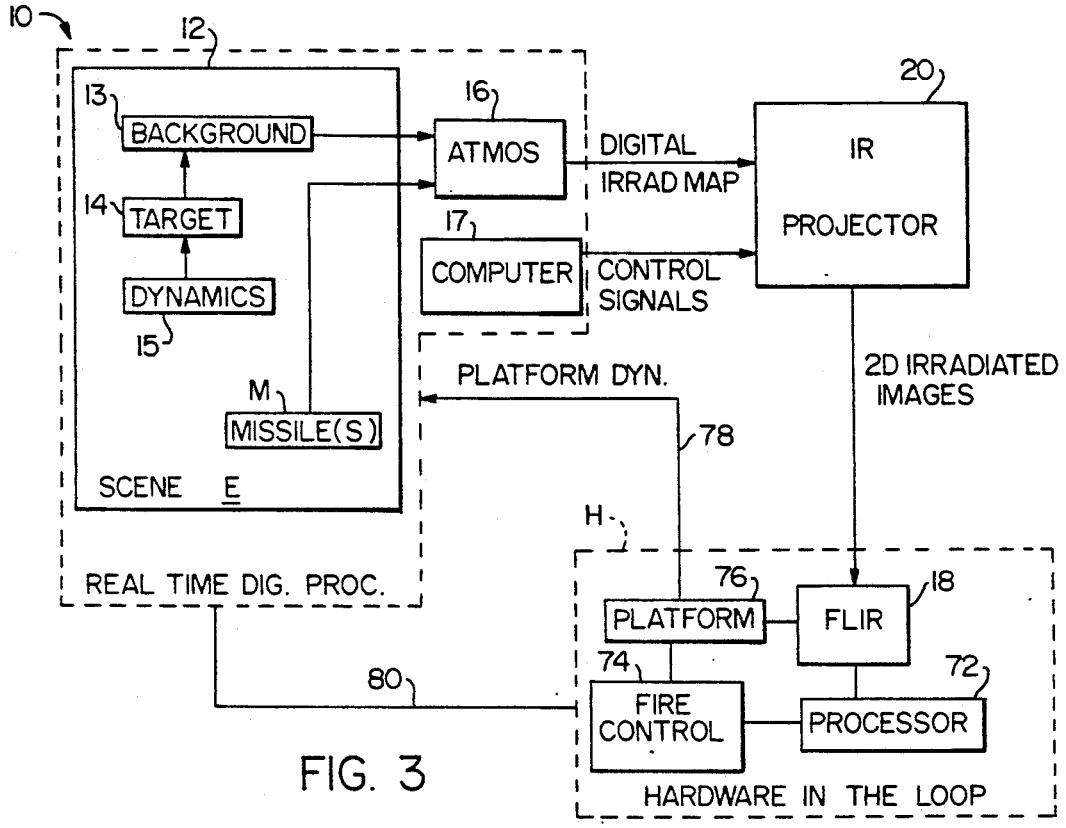
FIG. 3 is a block diagram of a TOW missile system simulator of the present invention.

Referring to FIG. 3, the present invention is directed to a simulator indicated generally 10 for training personnel in the use of the TOW missile system S. In particular, the simulator is a "hardware-in-the-loop" simulator in that the hardware portion H of system S is employed in the simulator. This is done to teach personnel how to acquire a target, launch a missile at it, and guide the missile to the target using the same equipment they would be using in an actual battlefield situation. The simulator is also a closed loop simulator and interreacts with the hardware H so the trainee can learn how his actions in following movement of the target about the battlefield effect guidance of a missile to the target in real-time.

Simulator 10 first employs a simulation means 12 which includes a means 13 which generates a background corresponding to the battleground scene E. Means 12 also includes means 14 for generating at least one target (T1, T2, etc.) within the scene. The simulating means further includes a means 15 for imparting dynamic movement to the target(s) so it (they) move about in the scene. In addition, means 12 includes a means 16 for generating atmospheric conditions such as the clouds C appearing on the battleground. Means 16 can also make the scene appear as a daytime or nighttime scene. It will be understood that means 13, 14, 15, and 16, are effected by appropriately programmed computer modules with the result that a digital map is created representative of the field-of-view observed by the trainee with a target moving about in it. The modules are controlled by a computer 17 which is programmed to control overall operation of the simulator.

The hardware H included as part of simulator 10 comprises a FLIR 18, which, as noted, is responsive to infrared radiation. Since the FLIR responds to infrared inputs, as opposed to digital signals, simulator 10 includes an interfacing means 20 for converting the digital output of means 12 into a radiance map. This, in turn, creates an infrared input for the FLIR. For effective simulation, it is important to be able to vary, on a pixel-by-pixel basis, the simulated field-of-view observed by the FLIR. To do this requires the ability to modify the background and target signatures at will, and, as will be discussed, to control the spatial position of the missile in the field-of-view. For generation of the background and target, the modules comprising means 13, 14, 15, and 16, incorporate digital infrared scene and digital infrared target models.

Figure 4:
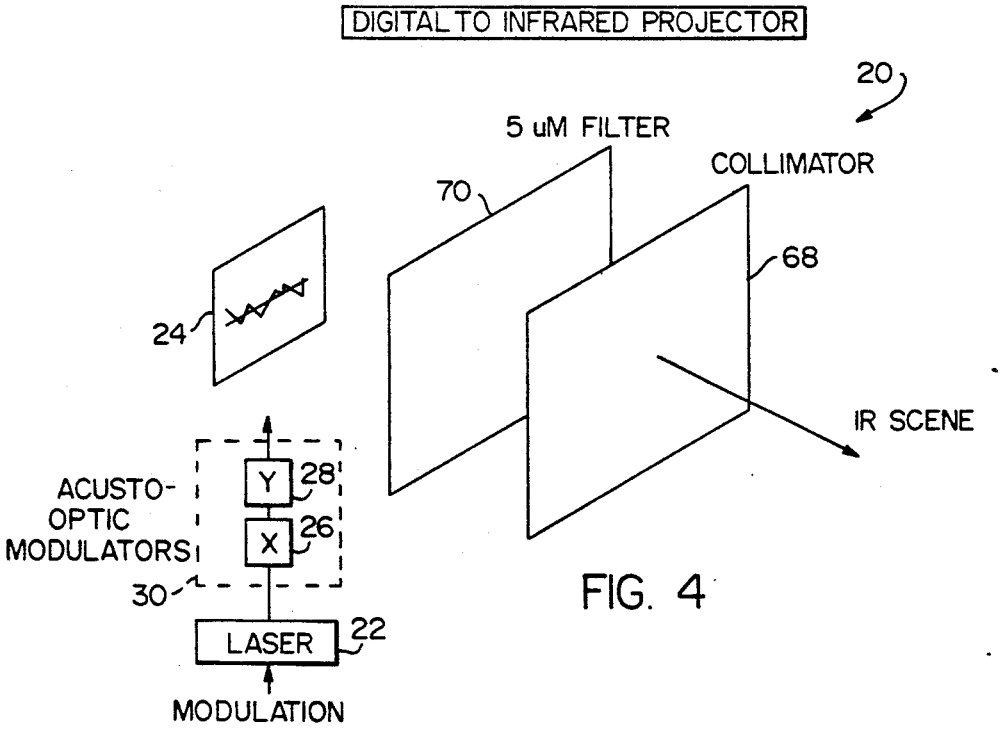
FIG. 4 represents a radiance converter portion of the simulator.
Figure 5:
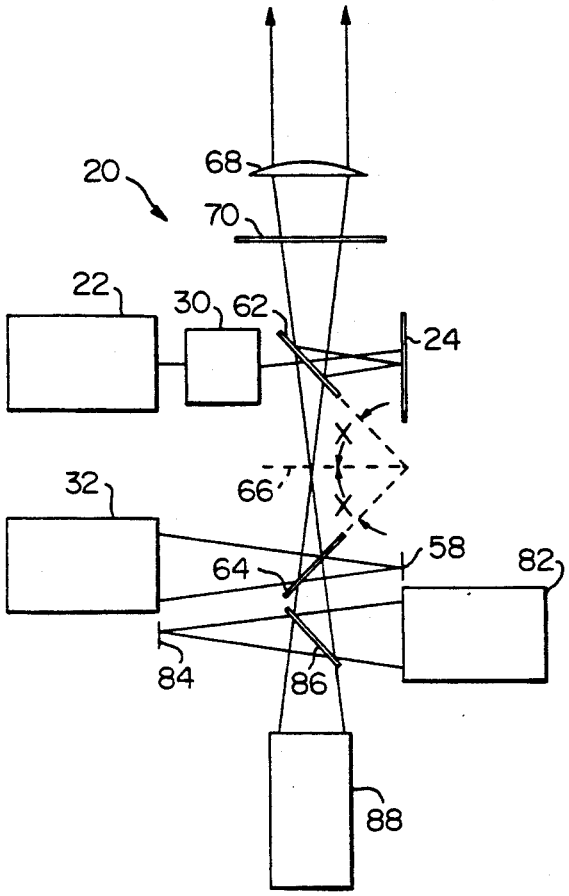
FIG. 5 represents an optical system used in the simulator.
Figure 6:
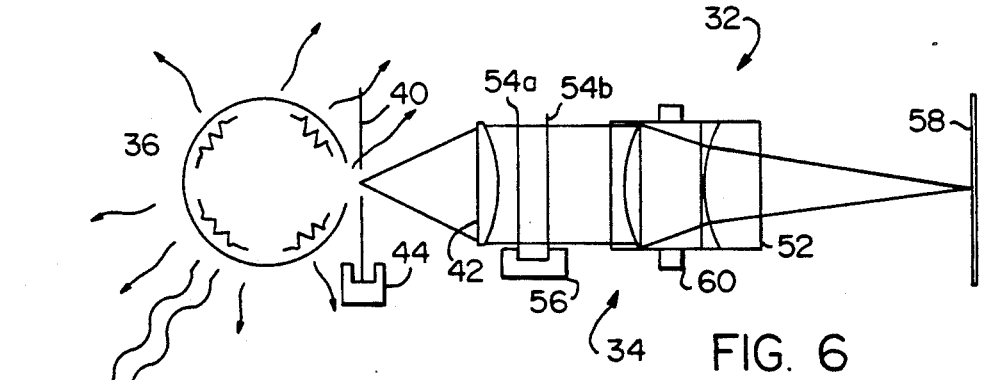
FIG. 6 represents an optics system used to produce an image of a TOW missile within the simulator; and, FIGS. 7*a* and 7*b* are face views of respective apertures employed with the optics system to produce images of the missile at different times in its flight.

Referring to FIGS. 4–6, interfacing means 20 includes a laser 22 whose beam, which may be at any wavelength from visible to infrared, is directed at a target image plate 24. The laser output is propogated through respective X and Y acousto-optic modulators 26, 28. The laser is intensity modulated by the digital output from simulation means 12 and this modulation is synchronized (by computer 17) with the operation of a scanning unit 30 which scans the laser beam, in raster, across the image plate. Modulators 26, 28 are incorporated in unit 30. By modulating the intensity of the laser as its beam is scanned across the image plate, a two-dimensional radiance map is produced. As a result, the dwell time of the beam on the plate is constant, as is the diffusion properties of the material forming the plate. The material has a reasonably long thermal lag time so it can be scanned with a low power laser at a reasonable scanning rate.

It will be understood, however, that the signature of the missile, which must be combined with the radiance map is very dynamic. This is because the maximum controllable range of the missile is approximately 10,000 ft. which the missile covers in less than 20 sec. from time of launch. During this time, there is an initial engine firing stage which must be effectively reproduced, and a subsequent coast stage in which the missile image must be converged from a side of the field-of-view (see FIG. 2*a*) to a target centered in the field-of-view in order to strike the target. In actuality, the distance between the launcher and the target is substantially less than the maximum which reduces the flight time to well under the 20 sec. period.

Figure 7A:
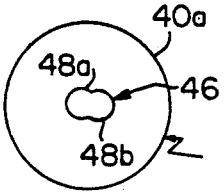
Figure 7B:
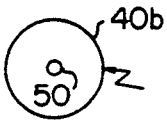

As shown in FIG. 6, a means 32 includes an optic means 34 for projecting an infrared image of the missile onto the radiance map viewed by FLIR 18. Means 32 includes a blackbody 36 which is heated by the beam from a laser 38. (It will be understood that the beam from laser 22 could also be used to heat the blackbody if a beamsplitter were used.) When heated, the blackbody emits infrared radiation uniformly in all directions. A portion of this radiation passes through a mask 40 and impinges on a collecting and collimating lens 42 of optic system 34. Referring to FIGS. 7*a* and 7*b*, mask 40 may either be a first apertured disk 40*a*, or a second apertured disk 40*b*. Both disks are mounted in a holder 44 which is controlled by computer 17 and operated in accordance with the lapsed flight time of the missile. Holder 44 first positions disk 40*a* between the blackbody and lens 42. Disk 40*a* has a "butterfly" shaped, centrally positioned aperture 46. The lobes 48*a*, 48*b* forming the aperture simulate the plumes P emanating from the sides of the missile when its engine is firing. Holder 44 is also capable of rotating the disk to simulate a roll maneuver by the missile during its initial powered flight. When the simulation time corresponds to the end of powered flight, holder 44 positions disk 40*b* behind disk 40*a* so the centrally positioned, circular aperture 50 in the disk is aligned with the center of disk 40*a*. Now, light radiating through aperture 50 represents the infrared radiation emitted by beacon B on the back of missile M.

Optic means 34 next includes a zoom lens 52 toward which light passing through lens 42 is directed. Interposed between the lenses are a pair of light polarizers 54*a*, 54*b*. The polarizers are mounted in a holder 56 which is controlled by computer 17 and rotates the polarizers in accordance with command signals from the computer. The positioning of the polarizers is important because they precisely determine the amount of radiance constituting the missile at any time. Since the missile is moving downrange away toward the target, the intensity of the missile radiance should constantly diminish. However, the rate by which it diminishes will vary since in its launch phase it is being accelerated away from the launcher at a increasing rate until the missile's engine shuts-down. During its second stage of flight it is coasting at a rate which is gradually decreasing because of friction with the air, gravity, etc. By properly rotating polarizers 54*a*, 54*b*, a light intensity profile established for the missile can be maintained.

Zoom lens 52 has a focal plane 58 which is a fixed focal plane. Since the image of the missile is established by mask 40, the missile will appear to be receding from an observer positioned at the focal plane. The zoom lens is mounted in a holder 60 which is controlled by computer 17. By rotating holder 60 the image of missile will appear to move away from the observer. It will be appreciated that operation of holders 44, 56, and 60 is synchronized to provide a dynamic image of the missile and, in effect, apply a third-dimension to the two-dimensional radiance map.

Referring to FIG. 5, means 22, 30, and 32 are shown as comprising a portion of interfacing means 20. In addition to these components, the optic means also includes a beamsplitter 62 which is positioned between scanning means 30 and target image plate 24. A second beam splitter 64 is positioned between missile image generating means 32 and the fixed focal plane 58. The beam splitters are angled with respect to each other, the angle of each beamsplitter being equal with respect to a virtual image plane 66 that is defined intermediate the two beamsplitters. The optical arrangement is such that the infrared images of the missile and the the image of the background and target are collected by a collimating optics or collimator 68. The image produced at this collimator is, in effect, the radiance map referred to previously. A filter 70 is interposed between the beamsplitter 62 and the collimator. The filter, which is, for example, a 5 uM filter, removes the laser beam wavelength from the light waves directed to the collimator.

As seen in FIG. 3, hardware H includes the FLIR 18 which receives the infrared images from the radiance map. In addition to the FLIR, the hardware portion of the simulator includes a signal processor 72, a fire control unit 74, and a platform module 76. Taking these components in reverse order, the platform module is used to generate the dynamics of the launch platform. These dynamics may be minimal or non-existent for a ground launched TOW missile as shown in FIGS. 1*a* and 1*b*, but if the missile is launched from a helicopter, then the dynamics are very important. The fire control module is used to launch the missile. It contains the launch system electronics including a missile self-test capability and an interface with the firing switch used by the trainee to launch the simulated missile. The processor is responsive to inputs from the FLIR to determine missile location in the field-of-view and the position of the missile relative to the point on the target on which the trainee has set the cross-hairs of reticle R. The processor uses these inputs to determine what guidance signals, if any, should be sent to the missile to guide it to the target.

The output signals from the hardware are supplied to simulating means 12 over a platform dynamics input line 78, and a control line 80. Line 80 represents the wires W which extend between the missile and the guidance and control hardware of the missile system. And it is important to note that the transmission from the hardware H to the simulating means is a "real time" transmission. Simulator 12 reacts to these transmissions to alter the dynamic representation of the missile in the generated scene so that it appears to react to the guidance output from the hardware. Thus, the missile system hardware is "in-the-loop". This allows the trainee to become familiar with the operation of the hardware, as well as that of the missile, under a variety of simulated conditions which he may later encounter on the battlefield.

Referring again to FIGS. 1*a*, 1*b*, 2*a*, and 2*b*, it was noted that more than one target may be present on a battlefield. Also, the target which perceives itself in danger from a TOW missile may activate countermeasures L in the hope of causing the TOW missile gunner to direct the missile away from the target in response to the presence of the countermeasure. Simulator 10 can be modified to present multiple battlefield targets as well as countermeasures which may be employed by the target. To simulate additional targets, module 14 can either be reprogrammed, or additional modules 14 can be added.

Because TOW missile systems with a multiple missile launch, tracking, and guidance capability are becoming available, means 82 (see FIG. 5) can be added to the interfacing means. Means 82 is identical in design and operation to the means 32 previously described, and will therefore not be described in detail. As part of the optics for means 82, a fixed focal plane 84 is provided, and a beamsplitter 86 is interposed between a zoom lens (not shown) of the means and the focal plane. Beamsplitter 86 is properly oriented with respect to beamsplitter 64 so the infrared light emissions from the means, representing a second missile, is focused at the virtual image plane 66.

Lastly, a means 88 can be provided to the interfacing means to provide a countermeasure presence capability. Means 88 is again similar to means 32 and 82 in that an infrared light is produced and focused at the virtual image plane. Where means 88 differs from means 32 and 82 is that the countermeasure is a fixed point of light located adjacent a target T. Thus, computer 17 co-ordinates the positioning of the infrared light output from means 88 in the the radiance map so it appears to move with the target employing it. Also, there is no need to provide the dynamics capability used in means 32 and 82 since the countermeasure does not have to appear to move away from the launcher toward the target. Rather, the source needs only to appear in the same plane as the target and thus always be the same distance from the launcher as the target.

In view of the foregoing, it will be seen that the several objects of the invention are achieved and other advantageous results are obtained As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A "hardware-in-the-loop" simulator for training people in the use of a missile system to teach target acquisition, missile launch, and missile guidance under simulated battlefield conditions comprising:

means simulating a battlefield environment including at least one target movable therewithin, said simulating means including means generating a digital signal representing the battlefield and the target;

hardware means including missile acquisition, tracking, and guidance portions of the missile system, the acquisition portion of the hardware means operating on images in an infrared portion of the light spectrum;

interfacing means for converting signals produced by the simulating means to signals acceptable by the hardware means as representing a field-of-view, including the target, within the battlefield environment, the interfacing means including means responsive to the digital signals from the simulating means for generating and projecting an infrared map representing the field-of-view, and the acquisition portion of the hardware means scanning said map to locate the target therewithin; and, image means for producing an image representative of the missile's position in the field-of-view, said image being acquirable by the hardware means which utilizes the acquired image to determine the position of the missile relative to the target and if a guidance signal is to be sent to the missile to guide it to the target, wherein the interfacing means is responsive to a guidance signal from the hardware means to simulate, in real-time, a dynamic response of the missile to the guidance signal, the image means comprising means for producing an infrared image of the missile and for superimposing the image on the map whereby the acquisition portion of the hardware means senses the position of the missile in the field-of-view, and the image means further including a blackbody and laser means for irradiating the blackbody to heat it to a temperature at which it emits infrared radiation.

2. The simulator of claim 1 wherein the map is a two-dimensional map.

3. The simulator of claim 1 wherein the image means further includes optic means for integrating the radiant image produced by heating the blackbody into the map.

4. The simulator of claim 3 wherein the optic means includes a collimating lens at which infrared radiation from the blackbody is directed, and a zoom lens at which light focused by the collimating lens is directed.

5. The simulator of claim 4 wherein the collimating lens and zoom lens are mounted in a fixed position relative to the blackbody, and the zoom lens has a fixed focal plane.

6. The simulator of claim 5 wherein the optic means further includes mask means interposed between the blackbody and the collimating lens for defining the image of the missile.

7. The simulator of claim 6 wherein the mask means includes a first mask having a first aperture therein representing the missile image during the initial portion of its flight when an engine of the missile is firing, and a second mask having a second aperture therein representing the missile image during a later portion of its flight when the engine is extinguished and a beacon on the missile is activated.

8. The simulator of claim 7 further including means for rotating the first mask to simulate missile roll during its initial stage of flight.

9. The simulator of claim 6 wherein the optic means further includes light polarizing means interposed between the collimating lens and the zoom lens and means for moving the polarizing means to precisely control the radiance from the blackbody.

10. The simulator of claim 9 wherein the optic means further includes beamsplitter means for imposing the image of the missile on the map for the acquisition portion of the hardware means to sense the presence of the missile image in the simulated field-of-view.

11. The simulator of claim 10 further including filter means for filtering out the laser light.

12. The simulator of claim 11 wherein the simulating means generates images of multiple targets within the field-of-view and the image means further includes means for producing the infrared image of a plurality of missiles.

13. The simulator of claim 11 wherein the image means further includes means for producing the infrared image of a missile countermeasure employed by the target.

14. The simulator of claim 1 wherein the simulating means includes means for generating atmospheric conditions on the battlefield.

15. A missile system simulator for use in training people for target acquisition, missile launch, and missile guidance under simulated battlefield conditions comprising:

simulating means for producing a digital signal representing a simulated battlefield environment including at least one target movable therewithin, the simulating means generating an infrared map representing the field-of-view and the target;

interface means for converting said digital signals to an infrared image;

missile system hardware including the missile acquisition, tracking, and guidance portions thereof, said hardware sensing the infrared image to determine the location of the target in a field-of-view; and, image means for generating an infrared image of a missile launched at the target and guided thereto, the image means imposing the missile image onto the field-of-view for the missile hardware to acquire the image of the missile in addition to that of the target, and to generate guidance signals to guide the missile image to the target image, wherein the interfacing means is responsive to a guidance signal from the hardware to simulate, in real-time, the response of the missile to the guidance signal, the image means including a blackbody, laser means for irradiating the blackbody to heat it to a temperature at which it emits infrared radiation, and optic means for integrating the radiant image produced by heating the blackbody into the infrared map.

16. The simulator of claim 15 wherein the optic means comprises a collimating lens at which infrared radiation from the blackbody is directed, a zoom lens at which light focused by the collimating lens is directed, and light polarizing means interposed between the collimating lens and the zoom lens for precisely controlling the radiance from the blackbody.

17. The simulator of claim 16 wherein the optic means further includes mask means comprising a first mask having a first aperture therein representing the missile image during an initial portion of its flight, and a second mask having a second aperture therein representing the missile image during a later portion of its flight.

18. The simulator of claim 17 wherein the optic means further includes beamsplitter means for overlaying the image of the missile onto the map.

19. The simulator of claim 18 further including filter means for filtering out the laser light.

20. A "hardware-in-the-loop" simulator for training people in the use of a missile system to teach target acquisition, missile launch, and missile guidance under simulated battlefield conditions comprising:

means simulating a battlefield environment including at least one target movable therewithin, said simulating means comprises means generating a digital signal representing the battlefield and the target;

hardware means including missile acquisition, tracking, and guidance portions of the missile system, the acquisition portion of said hardware means operating on images in an infrared portion of the light spectrum;

interfacing means for converting signals produced by the simulating means to signals acceptable by the hardware means as representing a field-of-view, including the target, within the battlefield environment, the interfacing means including means responsive to digital signals from the simulating means for generating and projecting an infrared map representing the field-of-view, and the acquisition portion of the hardware means scanning said map to locate the target therewithin; and, image means for producing an infrared image representative of the missile's position in the field-of-view and for superimposing the image on the map whereby the acquisition portion of the hardware means senses the position of the missile in the field-of-view, said image being acquirable by the hardware means which utilizes the acquired image to determine the position of the missile relative to the target an if a guidance signal is to be sent to the missile to guide it to the target, the image means including a blackbody and laser means for irradiating the blackbody to heat it to a temperature at which it emits infrared radiation, wherein the interfacing means is responsive to a guidance signal from the hardware means to simulate, in real-time, a dynamic response of the missile to the guidance signal.

21. A missile system simulator for use in training people for target acquisition, missile launch, and missile guidance under simulated battlefield conditions comprising:

simulating means for producing a simulated battlefield environment including at least one target movable therewithin and for generating a digital signal representative thereof, the simulating means generating an infrared map representing the field-of-view and the target;

interfacing means for converting said digital signals to an infrared image;

missile system hardware including the missile acquisition, tracking, and guidance portions thereof, said hardware sensing the infrared image to determine the location of the target in a field-of-view; and, image means for generating an infrared image of a missile launched at the target and guided thereto, the image means imposing the missile image onto the field-of-view for the missile hardware to acquire the image of the missile in addition to that of the target, and to generate guidance signals to guide the missile image to the target image, the image means including a blackbody, laser means for irradiating the blackbody to heat it to a temperature at which it emits infrared radiation, and optic means for integrating the radiant image produced by heating the blackbody into the infrared map, wherein the interfacing means is responsive to a guidance signal from the hardware to simulate, in real-time, the response of the missile to the guidance signal.

* * * * *